US008651010B2

(12) United States Patent
Smirnov

(10) Patent No.: US 8,651,010 B2
(45) Date of Patent: Feb. 18, 2014

(54) SEMIAUTOMATIC PISTOL

(75) Inventor: Volodymyr Igorovych Smirnov, Zarichany Zhytomyr District (UA)

(73) Assignee: Volodymyr Igorovych Smirnov (UA)

( * ) Notice: Subject to any disclaimer, the term of this patent is extended or adjusted under 35 U.S.C. 154(b) by 320 days.

(21) Appl. No.: 12/935,306

(22) PCT Filed: Aug. 18, 2008

(86) PCT No.: PCT/UA2008/000051
§ 371 (c)(1),
(2), (4) Date: Sep. 29, 2010

(87) PCT Pub. No.: WO2009/139736
PCT Pub. Date: Nov. 19, 2009

(65) Prior Publication Data

US 2011/0041680 A1 Feb. 24, 2011

(30) Foreign Application Priority Data

May 12, 2008 (UA) ..... 2008 06212

(51) Int. Cl.
*F41C 9/00* (2006.01)

(52) U.S. Cl.
USPC ..... 89/147; 89/198; 422/7; 422/17

(58) Field of Classification Search
USPC ..... 89/138, 137, 190, 198, 147, 125; 42/69.01, 69.02, 2, 14, 16, 17, 7
See application file for complete search history.

(56) References Cited

U.S. PATENT DOCUMENTS

| | | | | | |
|---|---|---|---|---|---|
| 802,279 | A | * | 10/1905 | Frommer | 89/138 |
| 1,756,847 | A | * | 4/1930 | Bourth | 89/138 |
| 3,857,325 | A | * | 12/1974 | Thomas | 89/138 |
| 4,031,648 | A | * | 6/1977 | Thomas | 42/70.02 |
| 4,825,744 | A | | 5/1989 | Glock | |
| 5,105,570 | A | * | 4/1992 | Lishness et al. | 42/69.01 |
| 5,179,233 | A | * | 1/1993 | du Plessis | 42/69.02 |
| 5,355,768 | A | * | 10/1994 | Felk | 89/147 |
| 5,678,342 | A | * | 10/1997 | Felk | 42/69.02 |

FOREIGN PATENT DOCUMENTS

| | | |
|---|---|---|
| RU | 2126521 C1 | 2/1999 |
| UA | 47344 C2 | 9/2006 |

* cited by examiner

*Primary Examiner* — Jonathan C Weber
(74) *Attorney, Agent, or Firm* — Clements Bernard PLLC; Seth L. Hudson

(57) ABSTRACT

The invention relates to the trigger and firing mechanisms for pistols. The inventive pistol comprises a frame (1), a barrel (2) with a cartridge chamber (3), a cartridge feeding mechanism (4), a fired case removing mechanism and a breech block return spring (12). The breech block (13) is slidable parallel to the barrel axis and comprises a firing mechanism, which consists of a firing spring stop (14), a firing spring (15), a striker (16) having a firing pin tip (17), a cocking notch (18) and rest pads for a firing spring (19) and for a striker spring (20). The breech block (13) includes a mechanism for sinking the firing pin tip (17) in a position, which makes possible the chambering of a cartridge, said mechanism having a striker spring (21), the force of which in a precompressed condition is greater than the precompressed force of the firing spring (15). The striker spring stop (22) is installed in the breech block (13) for fixing the precompressed force of the striker spring (21). The invention improves the positioning accuracy of the striker during the loss of resilience of the spring thereof.

3 Claims, 1 Drawing Sheet

A-A

SEMIAUTOMATIC PISTOL

CROSS REFERENCE TO RELATED APPLICATIONS

This application is a nationalization in the United States of PCT Application No. PCT/UA 2008/000051, filed 18 Aug. 2008, based on Ukraine Patent Application a 2008 06212 filed 12 May 2008.

BACKGROUND OF THE INVENTION

This invention relates to the field of small arms, more particularly to trigger and firing mechanisms for pistols.

Pistols having a combination of single-action and double-action trigger and firing mechanisms are known in the art. For example, the Walther P-99 pistol has such a combination and is well known. The pistol comprises a barrel with a cartridge chamber, a slide that is movable substantially parallel to the barrel axis under the action of a return spring. The slide includes a firing mechanism that consists of a firing spring stop, a firing spring, a striker having a firing pin tip, a cocking notch, rest pads for a firing spring and for a striker spring. The slide further includes a mechanism for sinking the firing pin tip having a striker spring.

Also known in the art is a double-action trigger mechanism comprising a trigger, a trigger slide that has an inclined surface for interaction with a frame, a projection for double-action (nose of sear), and a trigger spring. In addition, the pistol comprises a frame, a cartridge feeding mechanism represented by a box magazine and a spent case removing mechanism represented by extractor and ejector (<<Master gun>> magazine, No 22, 1998, p. 19-26).

Another feature of known pistols is the equality of efforts, applied to a striker in opposite directions by a firing spring and a striker spring in the uncocked condition of a striker and also an increased clearance between the cocking notch and projection for double-action (nose of sear) to make up for the shift of a cocking notch towards a cartridge chamber due to loss of resilience of a striker spring. Hence the disadvantage of said pistol is the increased trigger stroke, when shooting with double-action.

The closest analogue for the present invention that includes a combination of substantial features is known in the prior art and to the applicant. The instant analogue is the Saint-Etienne (Le Francais) pistol, 1927 year model. This pistol has a double-action only trigger and firing mechanism.

The Saint-Etienne pistol comprises a frame, a barrel with a cartridge chamber, a cartridge feeding mechanism represented by a box magazine, a fired case removing mechanism, utilizing powder gases and having an ejector fixed on a frame, a double-action trigger mechanism, including a trigger with a trigger slide, on which a projection for double-action is formed, as well as a projection for interaction with a frame. In addition, the trigger mechanism includes a trigger spring on its guiding rod and a pin. The pistol also has a breech block return mechanism consisting of a return spring on its guiding rod and two levers having journals.

The breech block of the pistol is movable substantially parallel to a barrel axis and comprises a firing mechanism including a stop nut, a firing spring, a striker having a firing pin tip, a cocking notch and rest pads for a firing spring and for a striker spring. In addition, the breech block contains a mechanism for sinking the firing pin tip in a position that makes it possible for the chambering of a cartridge. The breech block also has a striker spring which acts upon the striker and via same on a firing spring. When the firing pin tip is in a sunken position and the striker is in the uncocked condition, the striker spring and firing spring are in a state of preliminary compression (Blagonravov AA Material part of small arms Book 1—M. Oborongiz, 1945.-p. 364-369).

A further feature of the pistol is the equality of efforts exerted on a striker in opposite directions by a firing spring and a striker spring, when in a state of preliminary compression, and an increased clearance between the cocking notch and projection for double-action (nose of sear). This is necessary in order to compensate for a shift of a cocking notch towards a cartridge chamber, as the striker spring loses its resilience. The decrease of resilience of the striker spring emerges owing to the fact that the said spring, as different from a firing spring, functions under conditions of a shock dynamic loadings of compression and, therefore, is more disposed to loss of resilience, that is the lessening of the force as well as linear dimension along its axis. An increased gap between a cocking notch of the striker and projection for double-action (nose of sear) results in increased trigger stroke, which is a disadvantage of known pistols.

Thus, a need exists for a pistol and in particular for a trigger/striking mechanism that overcomes the problems of the prior art. Therefore, an object of the present invention is the improvement of positioning accuracy of the striker and prevention of striker spring loss of resilience. This is achieved by means of limiting the striker displacement, in its uncocked condition, towards a cartridge chamber. Thus, in a semiautomatic pistol with a double-action trigger and firing mechanism according to the present invention, the trigger stroke is reduced.

BRIEF SUMMARY OF THE INVENTION

The problems present in the prior art are overcome by the present invention. These problems and limitations present in the prior art are solved by the present invention. The present invention is in its most general form a semiautomatic pistol, comprising a frame, a barrel with a cartridge chamber, a cartridge feeding mechanism, a fired case removing mechanism, a double-action trigger mechanism, a breech block return spring, the force of which ensures the closed position of breech block before a shot is fired. The invention further includes a breech block installed with a possibility of sliding substantially parallel to the barrel axis and containing a firing mechanism. The firing mechanism comprises a firing spring stop, a firing spring, a striker having a firing pin tip, a cocking notch, rest pads for a firing spring and for a striker spring. The breech block further includes a mechanism for sinking the firing pin tip in a position, which makes it possible to chamber a cartridge. The said mechanism having a striker spring installed with possibility of interaction with a striker and via same with a firing spring, the direction of forces exerted on a striker by said springs being opposite. In addition, in a sunk position of a firing pin tip and uncocked condition of a striker, the striker spring and firing spring are mounted in a position ensuring a precompressed state thereof.

Further, according to the invention, in a breech block a striker spring stop is additionally installed in a position ensuring that the precompressed force of striker spring is greater than the precompressed force of the firing spring, but not to the extent as to prevent the firing mechanism from igniting a cartridge primer. As a result, as the striker spring lessens its resilience, in the uncocked condition of a striker, the cocking notch has no possibility of displacement towards the cartridge chamber, as long as a precompressed force of a striker spring exceeds the precompressed force of a firing spring.

The unchangeable position of the striker cocking notch rules out the necessity of increasing the gap between same, and a projection for double-action in order to compensate for a shift of a cocking notch towards a cartridge chamber due to loss of resilience of a striker spring. This results in a diminished trigger stroke.

The technical result, thus attained, is the improvement of the positioning accuracy of the striker. Further, the improvement results in preventing the striker spring from experiencing a loss of resilience. This is achieved by means of limiting the striker displacement, in its uncocked condition, towards the cartridge chamber. As such in a semiautomatic pistol with a double-action trigger and firing mechanism, the invention succeeds in creating a reduction of the trigger stroke.

In general, the present application is directed to a trigger mechanism for a double-action, semi-automatic pistol. The invention also has a trigger, a firing spring, and a striker that is slidably engaged in the pistol. The striker has a firing pin tip and a cocking notch and is positioned against a rest pad such that the striker spring exerts force on the striker in a direction away from a loaded cartridge. The invention also contemplates a firing spring positioned against a rest pad such that the firing spring exerts force on the striker in a direction toward the loaded cartridge. The precompressed force of the striker spring exceeds the precompressed force of the firing spring.

The present application is further directed to a trigger mechanism including a breech block. The breech block has a mechanism for sinking the firing pin tip in a position which makes it possible to chamber a cartridge. The breech block of the invention also includes a striker spring stop.

The present invention further contemplates a semi-automatic pistol that has a frame, a barrel with a cartridge chamber, a cartridge feeding mechanism, a fired case removing mechanism, a double-action trigger mechanism, a breech block that is slidable substantially parallel to the barrel axis, and a breech block return spring where the force of the spring ensures the closed position of the breech block before firing. The present invention also includes a firing mechanism with a firing spring stop, a firing spring, a striker having a firing pin tip, and a cocking notch, rest pads for the firing spring and for the striker spring. The breech block further includes a mechanism for sinking the firing pin tip in a position which makes it possible for the chambering of a cartridge. The mechanism has a striker spring adapted to interact with the striker and the firing spring where the direction of forces applied to the striker by the springs is opposite. The invention further contemplates that when the striker is in an uncocked position and the firing pin tip is in a sunk position, the striker spring and firing spring are mounted in a precompressed state ensuring that the precompressed force of the striker spring exceeds the precompressed force of the firing spring.

BRIEF DESCRIPTION OF THE SEVERAL VIEWS OF THE DRAWINGS

FIG. 1 shows the pistol in a loaded condition, with a closed position of the breech block, sunk position of the firing pin tip, and uncocked condition of the striker.

DETAILED DESCRIPTION OF THE INVENTION

Figure 1:
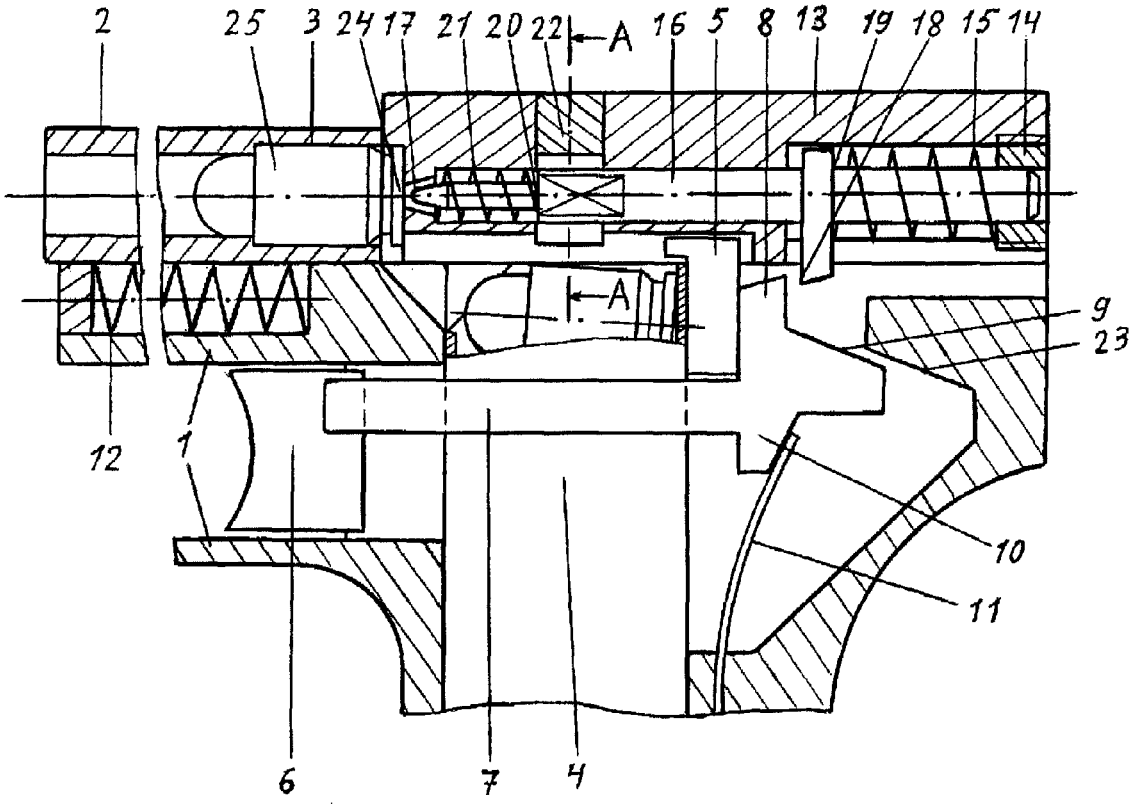
FIG. 1 is a perspective view of the present invention.
Figure 2:
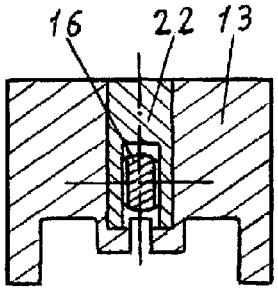
FIG. 2 is a rear view of the transverse section A-A of the breech block according to the present invention.

The pistol has a frame 1, a barrel 2 with a cartridge chamber 3, a cartridge feeding mechanism 4 (represented by a box magazine), and a spent case removing mechanism by means of powder gases having an ejector 5. The trigger mechanism consists of a trigger 6 formed unitarily with a trigger slide 7, on which is formed a projection for double-action (nose of sear) 8, an inclined surface 9 for interaction with a frame surface 23. In addition, the trigger mechanism contains a projection 10 for interaction with a trigger spring 11.

In the frame 1 a breech block return spring 12 is mounted. The breech block return spring 12 acts upon a breech block 13, installed on a frame 1, adapted to slide substantially parallel to the barrel 2 axis. Inside of the breech block 13, a firing mechanism is located. The firing mechanism includes a firing spring stop 14, a firing spring 15, and a striker 16 with a firing pin tip 17 and cocking notch 18. Integral to the striker 16 is a rest pad for a firing spring 19, against which bears the firing spring 15, as well as a rest pad for a striker spring 20. The striker spring 21 bears in a direction opposite that of the firing spring 15.

Further included in the breech block 13 is a striker spring stop 22. The striker spring stop 22 is installed in a position ensuring that the precompressed force of the striker spring 21 is greater than the precompressed force of the firing spring 15. However, the force cannot be so much greater as to impede the firing mechanism from igniting the cartridge primer 24. The striker spring 21 rests against the striker spring stop 22.

The pistol functions as follows. Pulling the trigger 6 moves the trigger slide 7 rearwards from a cartridge chamber 3, and pressing against the trigger spring 11. The projection for double-action (nose of sear) 8 closes the gap between the projection 8 and the striker cocking notch 18. The projection 8 comes into contact with the striker cocking notch 18 urging the striker 16 rearwards away from the cartridge chamber 3. This compresses the firing spring 15 via the rest pad for the firing spring 19. Simultaneously, the rest pad for the striker spring 20 disengages from contact with the striker spring 21, and is braced only against the striker spring stop 22. The breech block 13 doesn't move because its movement is arrested by the action of the breech block return spring 12.

On further displacement rearwards from the cartridge chamber 3, the trigger slide 7 starts to contact frame surface 23. This urges the rear part of said trigger slide 7 and the integral projection for double-action (nose of sear) 8 downwardly, away from the breech block 13. This also loads the trigger spring 11. The projection for double-action (nose of sear) 8 disengages from the striker cocking notch 18 thereby releasing the striker 16. Under the action of the firing spring 15 on a rest pad for firing spring 19, the striker 16 and the integral firing pin tip 17 are propelled forward toward the cartridge chamber 3. Further, the rest pad for the striker spring 20 comes into contact with the striker spring 21 causing the striker spring 21 to compress. Striker 16 with the firing pin tip 17 contacts the cartridge primer 24, and owing to the energy accumulated when cocked, strikes that cartridge primer 24 with sufficient force to activate the cartridge primer 24, thus firing the cartridge 25.

Under the action of the striker spring 21 on the rest pad for the striker spring 20, the striker 16 with the firing pin tip 17 is sunk in a position, ensuring an unimpeded chambering of a cartridge. Striker spring 21 is braced against the striker spring stop 22, and striker 16 bears via rest pad for a striker spring 20 against said spring, reassuming with the firing pin tip 17 and cocking notch 18 the uncocked position.

Once a shot is fired, the breech block 13 moves rearwards from the cartridge chamber 3 under the action of powder gases on a cartridge case 25. The explosive force of the cartridge 25 discharging compresses the breech block return spring 12 and allows for ejecting the fired case 25 from the pistol when the fired cartridge 25 collides with the ejector 5.

Following the ejection of cartridge 25, the breech block 13, under the action of the breech block return spring 12, is returned to the closed position, thus chambering another cartridge 25 to the cartridge chamber 3. Because the projection for double-action (nose of sear) 8 is down from the path of a striker 16, the projection for double-action 8 is not engaged and the pistol is not cocked.

When the trigger 6 is released, the trigger slide 7, under the action of the trigger spring 11 pressing on projection 10, returns backwards to the cartridge chamber 3, simultaneously lifting its rear part upwards. The projection for double-action (nose of sear) 8 comes in front of the striker cocking notch 18 and all the parts of the pistol assume the uncocked position already described.

The foregoing discussion has been proffered as an exemplary description of the preferred embodiments of the present invention. The description has discussed and illustrated how the present invention works and can be applied to and used for its intended purpose. It is the intention of the inventors to claim the present invention in its broadest sense, and not be limited to the exemplary facets discussed above. The invention in its broadest sense is encompassed by the following claims which should be read.

The invention claimed is:

1. A trigger and firing mechanism for a double-action, semi-automatic pistol comprising:

a) a double-action trigger mechanism, b) a firing spring stop, c) a striker, slidably engaged in the pistol, said striker having a firing pin tip, a cocking notch, rest pads for a firing spring and for a striker spring, d) a striker spring positioned against a rest pad such that said striker spring exerts force on said striker in a direction away from a cartridge and adapted to interact via said striker with a firing spring, e) a firing spring positioned against a rest pad such that said firing spring exerts force on said striker in a direction toward a cartridge and adapted to interact via said striker with a striker spring, wherein in a sunk position of a firing pin tip and uncocked condition of a striker the precompressed force of the striker spring exceeds the precompressed force of the firing spring, but not to the extent as to prevent the firing mechanism from igniting a cartridge primer.

2. A trigger and firing mechanism according to claim 1 further comprising:

a) a mechanism for sinking the firing pin tip in a position which makes it possible to chamber a cartridge, said mechanism having a striker spring mounted in a breech block, wherein in said breech block a striker spring stop is additionally installed in a position ensuring that the precompressed force of said striker spring exceeds the precompressed force of the firing spring, but not to the extent as to prevent the firing mechanism from igniting a cartridge primer.

3. A semi-automatic pistol comprising:

a) a frame, b) a barrel with a cartridge chamber, c) a cartridge feeding mechanism, d) a fired case removing mechanism, e) a double-action trigger mechanism, f) a breech block, slidable substantially parallel to the barrel axis, g) a breech block return spring, the force of said spring ensuring the closed position of the breech block before firing, h) the breech block including a firing mechanism, said mechanism comprising a firing spring stop, a firing spring, a striker having a firing pin tip, a cocking notch, rest pads for said firing spring and for said striker spring, i) the breech block further including a mechanism for sinking the firing pin tip in a position which makes it possible for the chambering of a cartridge, said mechanism having a striker spring adapted to interact with said striker and via same with said firing spring, the direction of forces applied to said striker by said springs being opposite, wherein in said breech block a striker spring stop is additionally installed in a position ensuring that in an uncocked striker condition and in a sunk position of a firing pin tip the precompressed force of said striker spring exceeds the precompressed force of said firing spring, but not to the extent as to prevent said firing mechanism from igniting a cartridge primer.

* * * * *